United States Patent [19]

Whisson

[11] 4,109,429

[45] Aug. 29, 1978

[54] PANEL ERECTION

[76] Inventor: Hubert James Whisson, 89 King William Rd., Hyde Park, Australia, 5061

[21] Appl. No.: 802,417

[22] Filed: Jun. 1, 1977

[51] Int. Cl.[2] ..... E04C 3/32

[52] U.S. Cl. ..... 52/122; 52/127; 52/239

[58] Field of Search ..... 52/127, 584, 495, 122, 52/710, 738, 239; 248/245

[56] References Cited

U.S. PATENT DOCUMENTS

| | | | |
|---|---|---|---|
| 2,940,718 | 6/1960 | Beal | 248/245 |
| 3,004,636 | 10/1961 | Shane | 52/710 |
| 3,782,048 | 1/1974 | Corman | 52/738 |

*Primary Examiner*—John E. Murtagh
*Attorney, Agent, or Firm*—Jay L. Chaskin

[57] ABSTRACT

A post has flanges with inturned beads which form a narrow mouth, the beads being engaged by a non-circular head on a screw such that rotation of the head in one direction releases its engagement from the beads, and the panel member or frame member to be assembled to the post has a nut contained within a nut receiving cavity, the nut threadably engaging the screw so as to firmly clamp the member to the post.

8 Claims, 8 Drawing Figures

PANEL ERECTION

This invention relates to a means for the erection of a panel assembly, method of erecting a panel with posts to form the assembly, and to a panel assembly so formed.

BACKGROUND OF THE INVENTION

Many proposals have been made for the assembling and erection of panels, for example panels which may be used in the construction of modular furniture, for partitions, for display cases and the like. However certain problems have been encountered. In many instances the cost is unnecessarily high because of the amount of work required in forming the parts, sub-assemblies and assemblies, while in other cases there have been restrictions as to relative heights which become difficult to compensate for, for example when a partition is to be erected on an uneven or sloping floor. Some of the previously proposed panel assemblies have required the formation of notches in the posts and this has had the dual effect of weakening the posts and limiting the degree to which a panel height may be adjusted with respect thereto. Furthermore, some of the previously proposed panel assemblies have not been sufficiently aesthetically pleasing to meet a wide range of requirements.

BRIEF SUMMARY OF THE INVENTION

Briefly in this invention a post has flanges with inturned beads which form a narrow mouth, the beads being engaged by a non-circular head on a screw such that rotation of the head in one direction releases its engagement from the beads, and the panel member or frame member to be assembled to the post has a nut contained within a nut receiving cavity, the nut threadably engaging the screw so as to firmly clamp the member to the post.

More specifically, one aspect of this invention consists of means for the erection of a panel assembly, wherein the panel member (that is, a panel or panel frame), has a clamping hole extending inwardly from one edge thereof, a nut receiving cavity or aperture extending inwardly from a side face thereof and intersected by the clamping hole, a threaded clamping member having a non-circular head at one end extending into the hole, a nut positionable in the nut receiving cavity or aperture to be threadably engaged by the clamping member when located in the clamping hole, and a post having flanges with inturned beads forming a narrow mouth channel extending along at least one side thereof, the space between the beads and the head shape and size being such that the head can be inserted into the channel but is restrained by the beads from withdrawal therefrom upon rotation of the head within the channel through an angle of less than 180°.

Another aspect of the invention consists of a panel assembly comprising means wherein the head is in the channel and clamped against the beads by the nut applying pressure to a wall surface of said nut receiving cavity or aperture.

A still further aspect of this invention consists of a method of erecting a panel assembly wherein the threaded clamping member is inserted in the hole, the nut threadably engaged on the clamping member, the clamping member had inserted in the channel and rotated by approximately 90° to engage the channel beads, and the nut is tightened on the threaded member.

To facilitate rotation of the non-circular head through an angle of less than 180°, in a further aspect the invention includes a rotation limit plate on the threaded clamping member, having abutment means thereon which engage the panel, or means on the panel.

With this arrangement the rotation limit plate may be rotated by a limited amount so as to move the clamping member through about 90° thereby enabling the head to be positioned within the narrow mouth channel and rotated until the head engages against the back faces of the beads. The nut may then be rotated to clamp the edge of the panel against the post or frame to be firmly engaged thereby. In this invention the height of the panel along the post may be adjusted by relaxing the nut, moving the panel, and then re-tightening the nut. It will be appreciated that the post can comprise a length of extruded material simply cut to length without requiring further operations, for example notching operations. In another aspect, the invention includes locking spigots extending outwardly from the panel edges to engage in the narrow mouth channels in the side faces of the post.

In another aspect, the invention includes height adjustment pads engaging the lower ends of the posts.

BRIEF DESCRIPTION OF THE DRAWINGS

Three embodiments of the invention are described hereunder in some detail with reference to and are illustrated in the accompanying drawings, in which.

Figure 1:
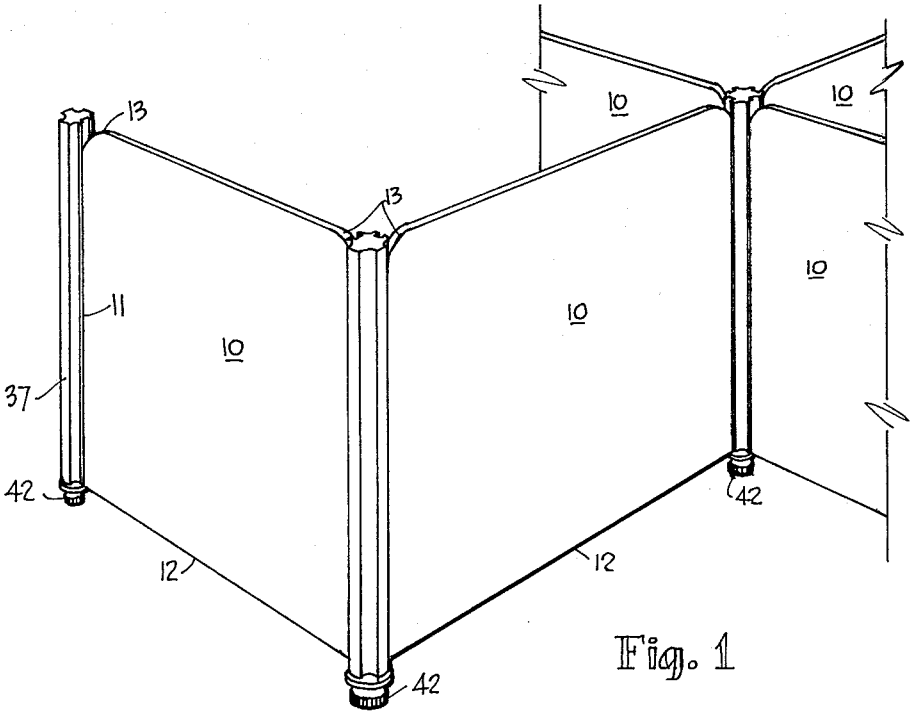
FIG. 1 is a perspective view of a panel assembly which includes a plurality of panels and posts in accordance with the invention.
Figure 2:
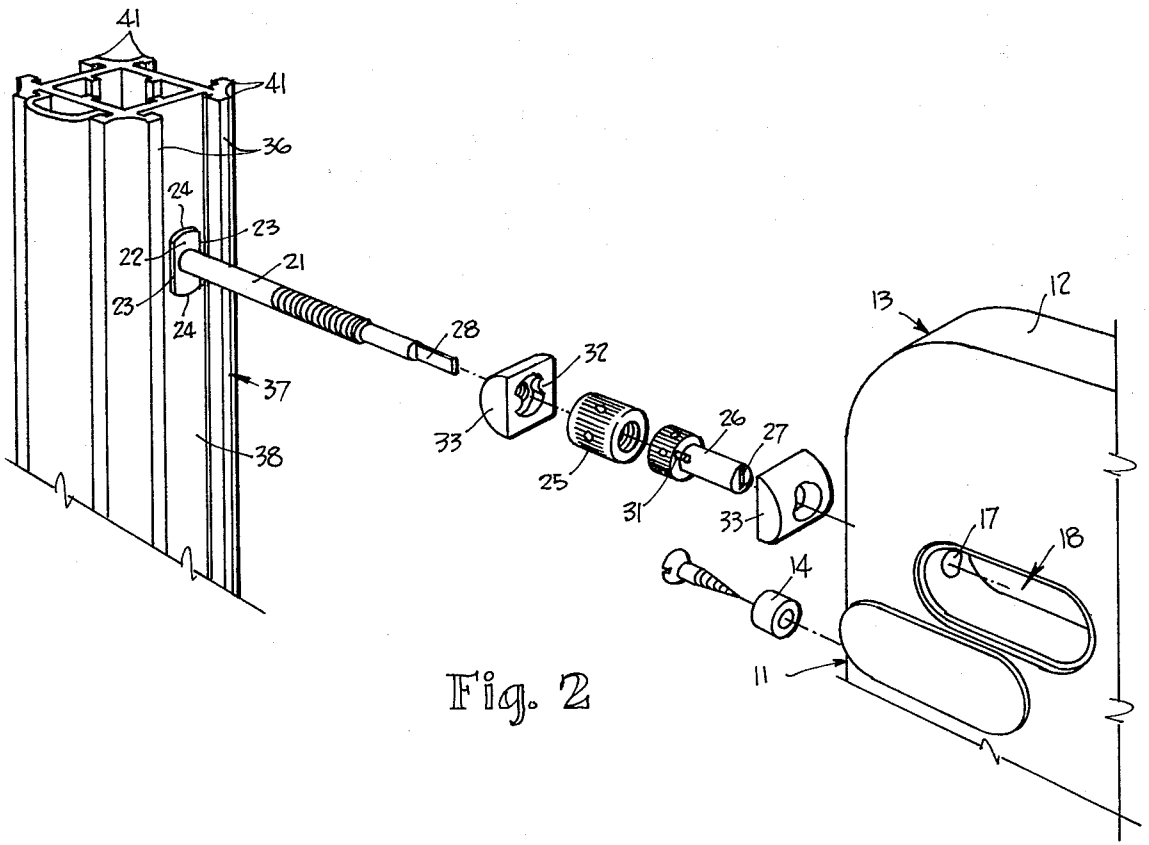
FIG. 2 is an "exploded" perspective view illustrating portion of a panel, a clamping member, and portion of a post.
Figure 3:
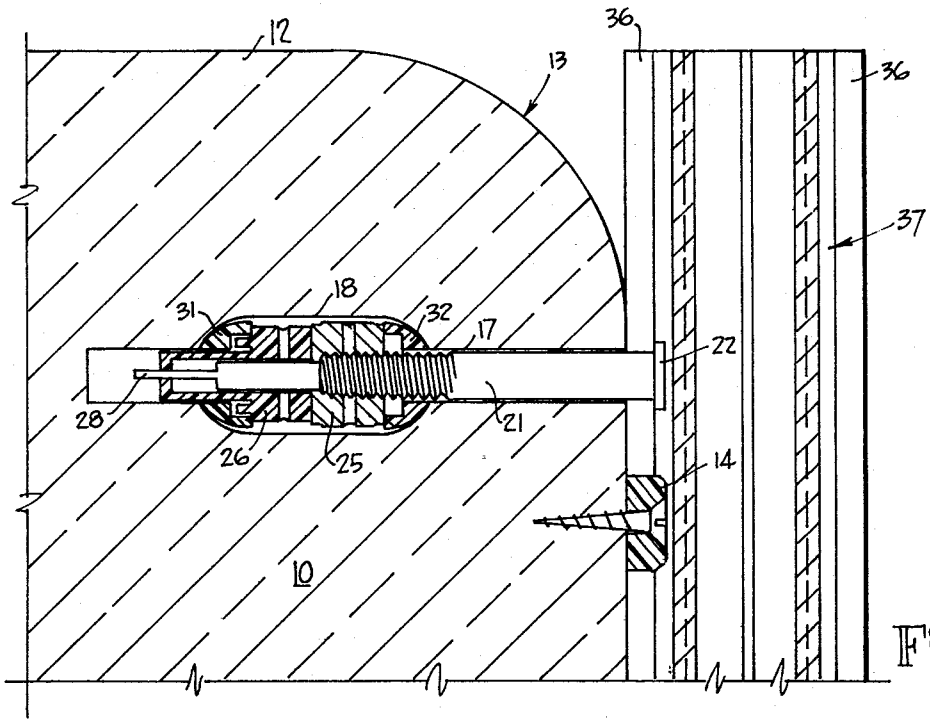
FIG. 3 is a fragmentary section to an enlarged scale which shows the means or the erection of the panel assembly, and in an assembled form.

In the first embodiment of FIGS. 1, 2 and 3, panel members comprise panels 10 which are each formed from lignose cellulose material (in this example, chip board) each panel having a facing lamina, two vertical edges 11, two horizontal edges 12 and curved upper corners 13. Each of the vertical edges 11 is provided with a locating spigot 14 positioned approximately centrally, and projecting outwardly horizontally. In some embodiments the spigot is not required.

Each panel vertical edge 11 is provided with two clamping holes 17 positioned one near the upper edge 12 and one near the lower edge 12, each hole 17 extending inwardly from a side edge of the panel. Each clamping hole 17 extends centrally into the panel 10 to intersect a nut receiving cavity 18 which extends inwardly from one side face (or aperture which extends from one face to the other). The cavity 18 has parallel upper and lower walls and curved end walls, and a closure plate 19 is positionable within the cavity, after assembly has taken place.

A threaded bolt like member constitutes a clamping member 21 having a head 22 which is non-circular and has two edges 23 which are closer together than the other two edges 24. The clamping member 21 is threadably engaged by a circular capstan nut 25 having a knurled outer surface, and a rotation limit sleeve 26 contains a rectangular (or other non-circular) slot 27 through which a corresponding rectangular (or other non-circular) end 28 of the clamping member is slidable. The rotation limit sleeve 26 in this embodiment is also a circular knurled member, thinner than the nut 25 but of approximately the same diameter, and is provided with outstanding abutment pins 31 which are engageable against abutment bosses 32 in one of two identical half-round abutment blocks 33 through which the clamping member 21 extends, in one position, and are also engageable upon rotation of the plate to another position at 90° thereto. The pins thus limit rotation of the sleeve 26, and since the sleeve 26 non-rotationally but slidably engages the clamping member end 28, rotation of the non-circular head 22 is also limited to about 90°. It is, of course, essential that rotation be limited to less than 180° or the head could be withdrawn from the post which it engages, as described below. The arrangement is such that in one of its limit positions the head faces which are closest together extend vertically and in the other limit position they extend horizontally, in the latter position the head then engaging the back faces of beads 36 of a post 37, if the head is first positioned into a narrow mouth channel 38, formed by the beads 36 and the side walls of the post 37.

Each post 37 in this embodiment is formed by an extrusion process, the posts being substantially square in cross-sectional shape and having two corner flanges 41 at each edge, the beads 36 being inturned beads of respective flanges 41, the beads on each side defining between them a narrow mouth channel 38. The posts 37 are supported by height adjustment pads 42, each height adjustment pad being a threaded bolt like member which threadably engages a sleeve (not shown) containing a female thread which extends within the post upwardly from its lower end. (In the alternative the sleeve may extend upwardly into the panel.)

In some embodiments (not illustrated herein), wherein locating spigots extend outwardly from the side edges of the panel, the post 37 contains aligned apertures so that there is an automatic alignment of the upper edges of a series of panels, for example in a partition. In most instances however it is desirable to regulate the height of each panel with respect to a post and this is achieved by merely slackening the nut 25 and sliding the non-circular head 22, and the spigot 14, up or down the channel 38 in which it is retained.

In the erection of a panel assembly, each capstan nut 25 and its respective rotation limit plate 26 is positioned in the nut receiving cavity 18 and the clamping member 21 is moved inwardly into its hole 17 in an axial direction until such time as the thread thereon is engageable by the nut 25, whereupon rotation will either be by the clamping member or the nut and will cause thread engagement therebetween. Rotation of the clamping member 21 is limited due to engagement of the non-circular end 28 of the clamping member 21 in the corresponding non-circular slot 27 in the rotation limit plate 26, as rotation causes inward movement of member 21. The clamping member is further engaged by the nut by further rotation of the nut.

The non-circular head 22 of the clamping member is then positioned to have the two edges 23 closest to one another positioned vertically, the head is positioned into a narrow mouth channel 38 and the rotation limit plate is then rotated by 90° so that the head bears against the back faces of the beads 36. Further tightening of the nut merely clamps the edge of the panel against the outer surfaces of the beads.

In a slight variation of the above, the thickness of the panel equals the distance between the facing surfaces of the beads so that the panel is retained for the length of its edge between the beads on the flanges. In such instances however it is necessary to at least slightly relieve the edges of the panels at the location of the respective clamping member apertures so that the head can be accommodated within the relief portion while the edges are firmly clamped against the webs of the channels.

Figure 4:
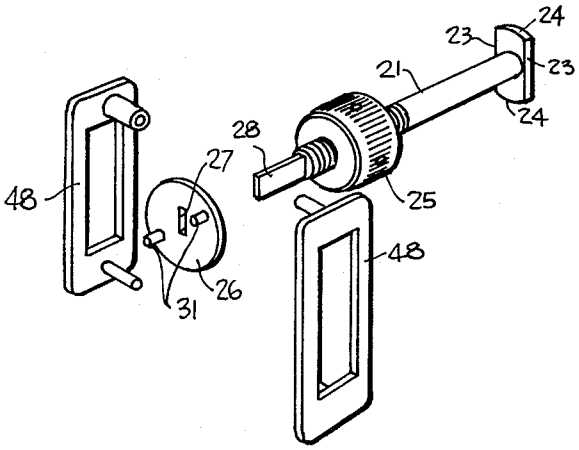
FIG. 4 is an "exploded" perspective view of a clamping assembly according to a second embodiment.
Figure 5:
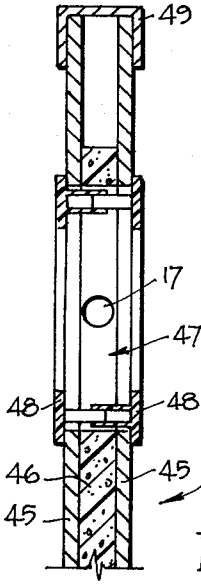
FIG. 5 is a fragmentary section through a panel which illustrates the panel configuration in the second embodiment.

In the second embodiment of FIGS. 4 and 5 a panel 10 is formed to have two outer skins 45 of thin veneered ply wood and an intermediate core 46 of foam polystyrene. Instead of there being a cavity 18 of the receiving of a nut, there is an aperture designated 47 which extends right through the panel from one face to the other, and surrounding the walls defining the aperture 47 are two interengaging escutcheon plates 48 shown also in FIG. 4, the escutcheon plates engaging one another with spigot and socket interconnection means. The edges of the panel 10 are closed by channel section aluminium extrusions 49.

In the first embodiment the capstan nut 25 and the rotation limit sleeve 26 were both of small diameter and wholly contained within the nut receiving cavity 18. In the second embodiment these elements exceed the panel thickness and project slightly beyond the escutcheon plates 48, the abutment pins 31 engaging respective escutcheon plates 48 as the rotation of the clamping member 21 approaches 90°. The abutments for the capstan nut 25 are constituted by inner edge surfaces of the escutcheon plates 48 and this obviates the need for abutment blocks 33 which were used in the first embodiment. In other respects the embodiment is similar and similar elements bear similar designations to those of the first embodiment. The drawing of FIG. 5 does not show the clamping member and nut assembly, this being omitted for the sake of clarity.

Figure 6:
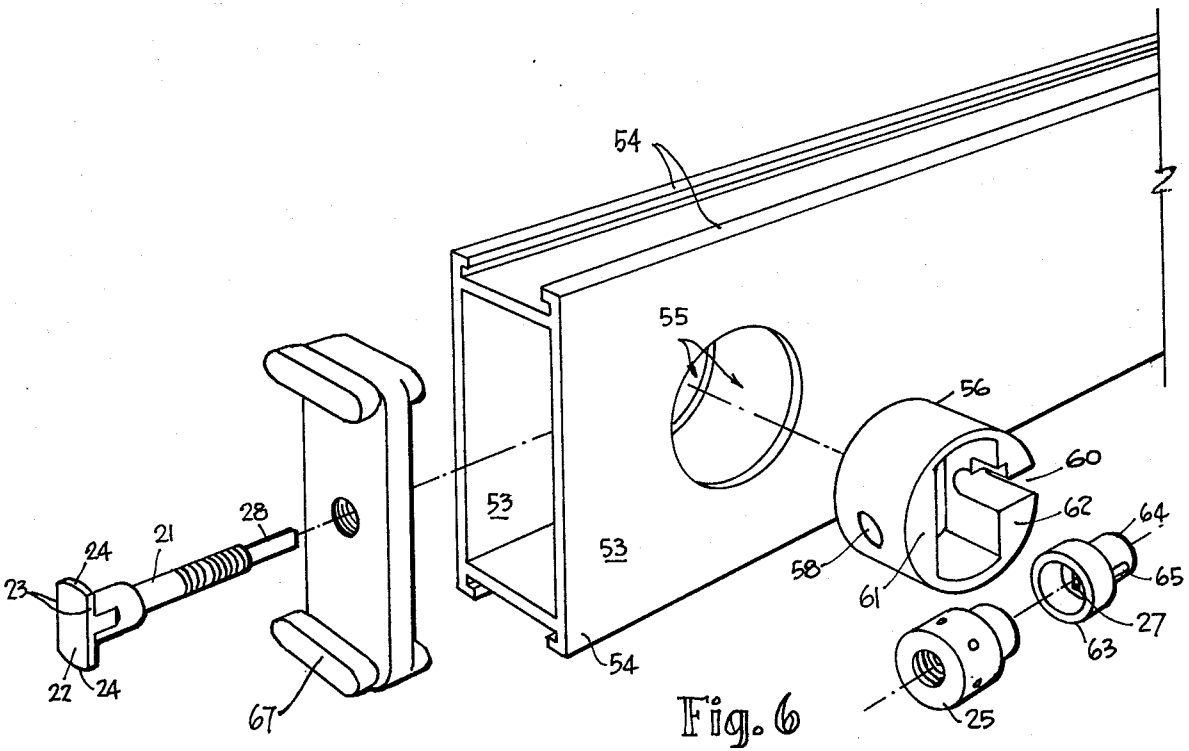
FIG. 6 is an "exploded" view of a third embodiment wherein a panel frame member is to be secured to a post.
Figure 8:
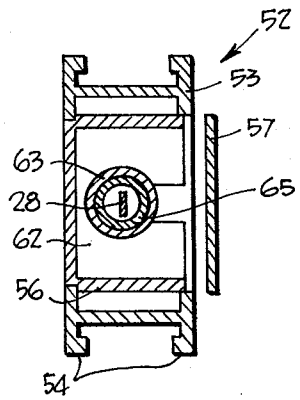
FIG. 8 is a fragmentary cross-section on line 8—8 of FIG. 7.
Figure 7:
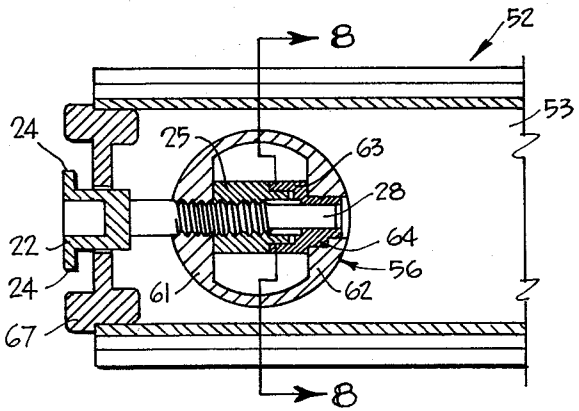
FIG. 7 is a fragmentary sectional elevation of same.

In the third embodiment of FIGS. 6, 7 and 8, again similar elements bear similar designations. In this embodiment, instead of a panel 10 being secured to a post 37, the panel member concerned is a panel frame 52 which is to be so secured, the panel frame 52 being a hollow section member having side walls 53, and panel edge retaining flanges 54. The panel frame side walls 53 contain aligned apertures 55 which receive a circular section socket 56, and a closure disc 57. The walls of the socket 56 contain an aperture 58 which accomodates the clamping screw 21, which is of a similar configuration to that used in the first embodiment of FIGS. 1, 2 and 3.

A capstan nut 25 is contained within the socket 56 and threadably engages screw 21, the capstan nut bearing at one end against an internal boss 61 of the socket 56. A second box 62 contains a slot 60 extending inwardly from one end of the socket 56, the slot 60 being defined by upper and lower walls. The rotation limit sleeve is a bush designated 63 which has a reduced diameter end 64 with an abutment 65 thereon, the abutment 65 alternatively abutting the upper and lower walls of slot 63 upon rotation of bush 63 by 90° and thereby limits rotation. Bush 63 has extending therethrough a rectangular section aperture 27 which slidably receives the end 28 of the clamping screw 21.

Closure block 67 closes the end of panel frame 52 and accurately locates it with respect to post 37 (not separately shown in this embodiment).

There is a frictional engagement between nut 25 and bush 63 such as to cause bush rotation (of 90° maximum) immediately nut 25 is rotated, and this facilitates assembly or disassembly of the frame to the post.

This invention contains many advantages over those of alternatives. For example a small panel may be associated with a cupboard which can be adjusted for height with respect to the panel. The arrangement is ideally suited for producing modular furniture and provides much more latitude of dimension than when the furniture elements have to be accurately located with respect to one another.

By engagement of the height pads with respect to the floor, the panels can be substantially free standing and the length of the posts can be reduced to be less than the height of the panels. The cost will be seen to be exceedingly small and the panels and posts or frames can be so arranged so as to be aesthetically pleasing.

I claim:

1. Means for the erection of a panel assembly wherein a panel member has a clamping hole extending inwardly from one edge thereof, a nut receiving cavity extending inwardly from a side face thereof and intersected by the clamping hole, a threaded clamping member having a non-circular head at one end, the other end of said member extending into the hole, a nut positionable in the nut receiving cavity to be threadably engaged by the clamping member when located in the clamping hole, a rotation limit sleeve also positionable in the nut receiving cavity and having a non-circular aperture extending therethrough, and also having abutment means thereon which are engageable against abutment surfaces on the panel or means fixed relative to the panel, said other end of the threaded clamping member being a co-operating non-circular end slidable in said non-circular aperture, the limit sleeve being operable to limit rotation of said threaded clamping member to less than 180°, and a post having flanges with inturned beads forming a narrow mouth channel extending along at least one side thereof, the space between the beads and the head shape and size being such that the head can be inserted into the channel but is restrained by the beads from withdrawal therefrom upon rotation of the head within the channel, through an angle of less than 180°.

2. Means according to claim 1 further comprising a pair of abutment blocks positionable in said cavity or aperture, at least one of said abutment blocks having abutment surfaces thereon which are engageable by said abutment means on said rotation limit plate.

3. Means according to claim 1 further comprising an escutcheon plate surrounding the walls defining the cavity or aperture, said abutment surfaces being surfaces of said escutcheon plates.

4. Means according to claim 1 wherein said abutment means on the rotation limit sleeve comprises at least one pin.

5. Means according to claim 1 wherein said abutment means limit rotation of said rotation limit plate to an angle which does not exceed 90°.

6. Means according to claim 1 wherein said panel member is a panel, and further comprising a spigot outstanding from a panel edge and engageable within the narrow mouth channel to locate the panel with respect to the channel walls.

7. Means according to claim 1 further comprising adjustment pads threadably engaging bushes which are positionable in the lower ends of the posts, said threadable engagement being adjustable for adjustment of panel height.

8. Means according to claim 1 wherein said panel member is a panel frame.

* * * * *